US005379975A

United States Patent [19]

Berkowitz et al.

[11] Patent Number: 5,379,975

[45] Date of Patent: Jan. 10, 1995

[54] INTERMATING TABLE LEGS

[75] Inventors: Alan J. Berkowitz; Elliott W. Baum; Lucian N. Chirea, all of St. Louis, Mo.

[73] Assignee: Berco Industries, St. Louis, Mo.

[21] Appl. No.: 46,300

[22] Filed: Apr. 15, 1993

[51] Int. Cl.[6] ..... F16M 11/20

[52] U.S. Cl. ..... 248/188.8; 108/150; 248/151; 297/440.1

[58] Field of Search ..... 248/188, 188.1, 188.8, 248/188.9, 188.91, 188.7, 151, 440.1, 150, 155.4, 165; 108/150, 134, 135; 297/440.13; 16/42 T, 42 R

[56] References Cited

U.S. PATENT DOCUMENTS

| | | | |
|---|---|---|---|
| 401,798 | 4/1889 | Spencer | 297/440.13 X |
| 1,903,631 | 4/1933 | Morrison | 108/150 |
| 1,984,602 | 12/1934 | Snyder | 108/134 X |
| 3,080,601 | 3/1963 | Kramcsak, Jr. | 248/188.9 X |
| 3,148,857 | 9/1964 | Hutchison | 108/135 UX |
| 3,164,347 | 1/1965 | McMasters | 108/150 X |
| 3,173,168 | 3/1965 | Nordmark et al. | 16/42 R |
| 3,185,423 | 5/1965 | Jones, III | 108/150 X |
| 4,039,131 | 8/1977 | Perrault et al. | 248/903 X |
| 4,169,625 | 10/1979 | Petersen | 248/188.7 X |
| 4,406,437 | 9/1983 | Wright | 248/188.7 X |
| 4,433,753 | 2/1984 | Watson | 297/440.13 X |
| 4,712,758 | 12/1987 | Cuschera | 248/188.7 |
| 5,022,620 | 6/1991 | Scott | 248/188.7 X |

*Primary Examiner*—Ramon O. Ramirez
*Attorney, Agent, or Firm*—Paul M. Denk

[57] ABSTRACT

An intermating table leg assembly formed to support a table top, with the table pedestal providing the support being formed of two pairs of table legs, each pair of table legs having two aligned legs provided therein, and rigidly held together by means of a connector, with the connector of one pair of table legs interfitting into the connector of another pair of table legs, which are arranged in perpendicularity, when the legs are assembled into a pedestal structure, for support of a table top thereon, when the table is assembled for usage. A styled foot is provided at the bottom end of each table leg to buffer it upon the floor when the table is utilized, and the upper end of each table leg connects a mounting plate, that accommodates threaded fasteners for securement of the pedestal to the underside of a table top, when fabricated.

6 Claims, 4 Drawing Sheets

INTERMATING TABLE LEGS

BACKGROUND OF THE INVENTION

A variety of pedestal formed tables incorporating various styles of legs have long been available in the art. Normally, either a singular pedestal, or even a pair of the same, may be mounted to the underside of a table top, and generally extends out in various angular directions, or has a base that extends laterally of the table pedestal, to provide adequate support for the table top thereon. These types of tables are readily available in the art, and have been in existence for many years.

The current invention is designed to improve upon the concept of pedestal tables, by incorporating intermating leg components, that may be interconnected together to form a pedestal, for adequate support of any table top or surface provided thereon.

SUMMARY OF THE INVENTION

This invention contemplates the formation of a pedestal type table, wherein the pedestal is formed generally of two pairs of table legs, which legs are arranged adjacent each other, having a connector disposed intermediately thereof, to rigidly fix each pair of legs together, while another pair of similarly constructed table legs, held together by a connector, can be intermated with the first pair, through the sliding connection made between their respective connectors, to form the desired perpendicularity or other angular relationship required for formation of a stable pedestal, upon which a table top or surface may be applied. A unique advantage of this particular invention, by forming pairs of table legs fabricated into an assemblage that may be intermated together, to form the complete pedestal, is that each pair of table legs forming one-half of the pedestal, are generally of a flattened configuration, and therefore, the entire table assembly, when in its disassembled condition, can be shipped in a flattened configuration, since the table legs, before their assembly, are of similar appearance extending generally and principally in two dimension, which allows for and accommodates their flattened disposition, when packaged, as during shipment to a customer, or when displayed, stored or warehoused.

Each of the connectors disposed between a pair of legs, and which are welded or otherwise secured intermediate each pair of legs, is fabricated to provide for its intermating with the connector of the other pair of legs, so that perpendicularlity can be arranged between the two pairs of table legs when they are intermated together, to form the erected pedestal, before its table top is applied thereon.

Further means for facilitating the usage of the formed pedestal of this invention includes a uniquely designed foot member, that matingly secures with the bottom of each table leg, and which provides for the buffered support of the table leg upon any base, or floor. In addition, the upper end of each table leg includes a mounting plate, that extends radially outwardly from the intended pedestal, and which is welded or otherwise secured to the top of each table leg, and can accommodate fasteners, such as threaded screws, to facilitate the securement of the table top thereon, when the intermated table legs of this invention are assembled into a table configuration.

It is, therefore, the principal object of this invention, to provide for the formation of a pair of table legs, which may be intermated with a corresponding pair of table legs, to form a pedestal for support of a table top structure.

Another feature of this invention is to provide a pair of table legs, which may be assembled into a pedestal type of table, wherein in the disassembled configuration, the various pairs of table legs may be rested one on top of the other, when packaged or stored, to significantly reduce their dimensions when warehoused, shipped, or displayed for sale.

Another object of this invention is to provide for a reinforced mounting plate that integrally connects to the upper end of each table leg, and is readily available for connection to the underside of a table top, when a pedestal table is assembled.

Yet another object of this invention is to provide for the intermating connectors between each pair of table legs, which are contoured to accommodate table legs of differing designs, and to provide for their securement intermediate each pair of legs at any dimension along their height, whether it be at the bottom, at an intermediate position, or upwardly of the pair of secured legs that each form one-half of the entire table pedestal structure.

These and other objects may become more apparent to those skilled in the art upon review of the summary of this invention, and upon undertaking a study of the description of its preferred embodiment, as disclosed in the drawings.

DESCRIPTION OF THE PREFERRED EMBODIMENT

Figure 1:
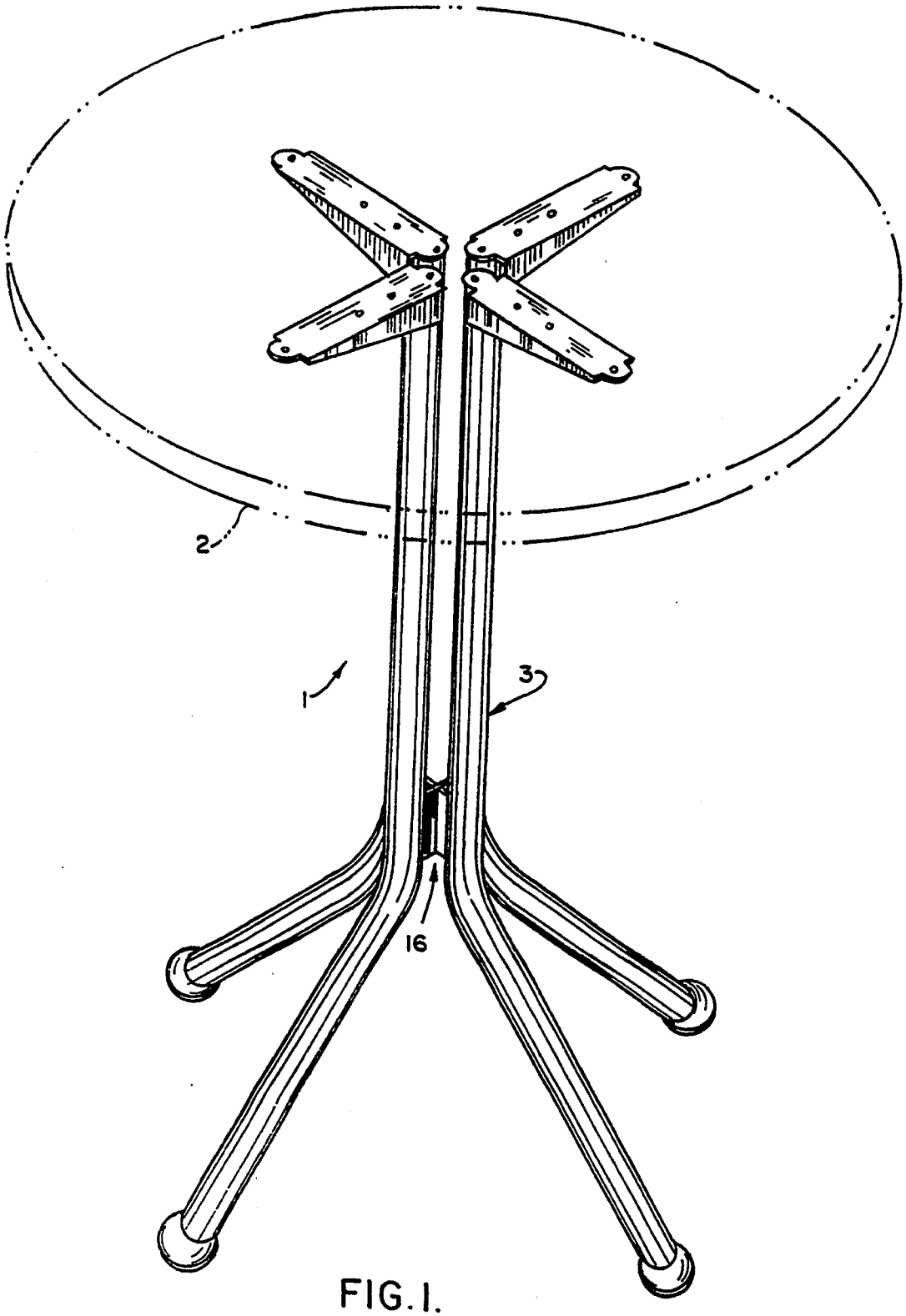
FIG. 1 provides an isometric view of the intermating table legs forming the pedestal table of this invention.
Figure 2:
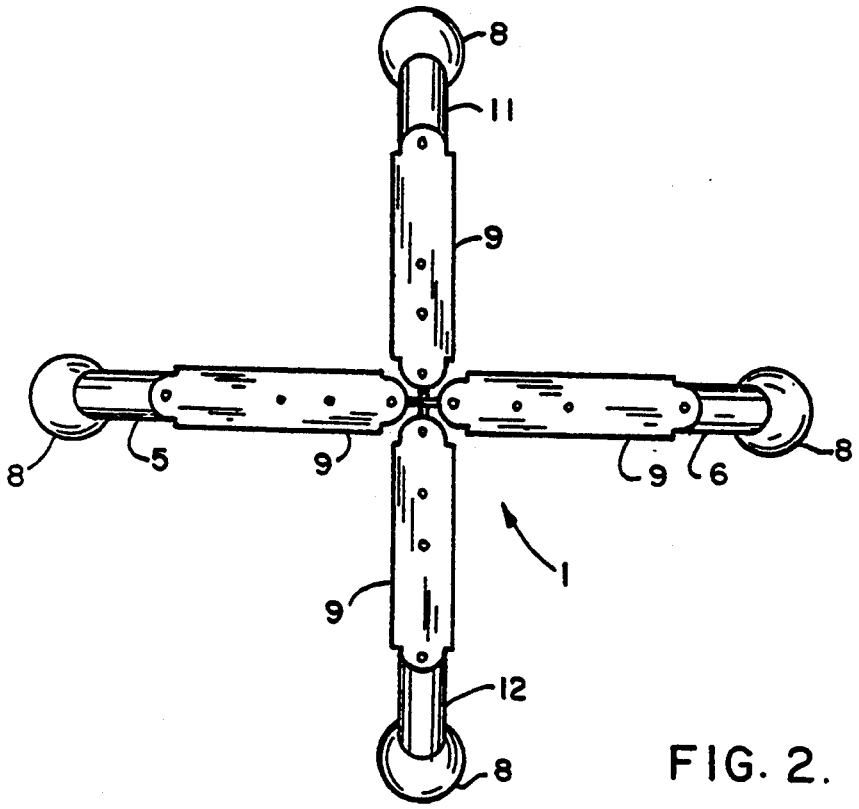
FIG. 2 is a top plan view thereof.
Figure 3:
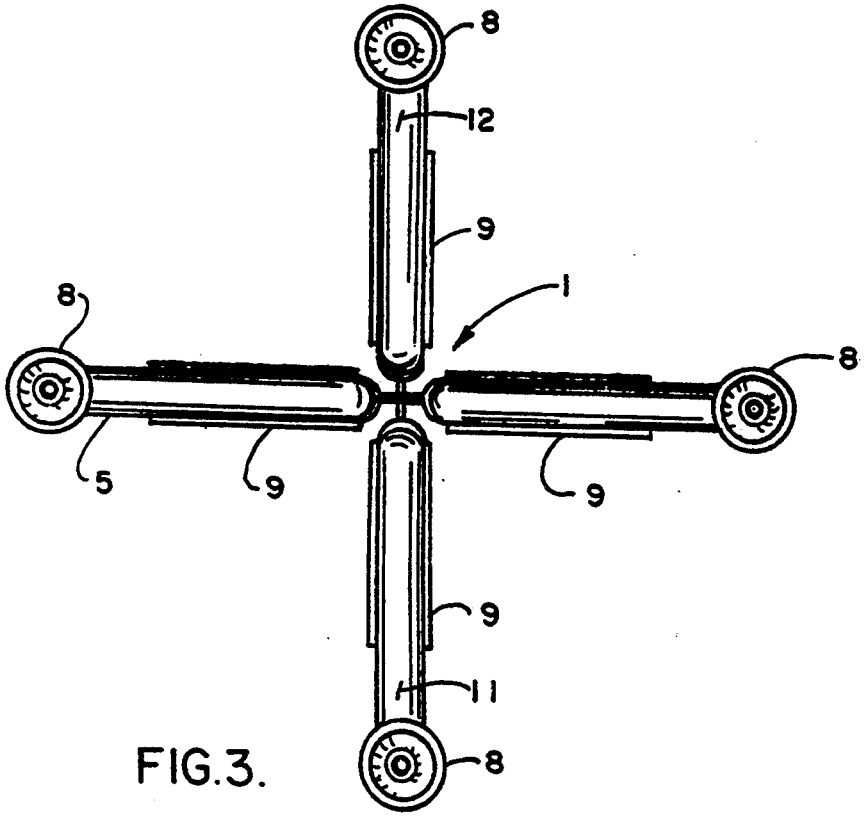
FIG. 3 is a bottom view thereof.
Figure 7:
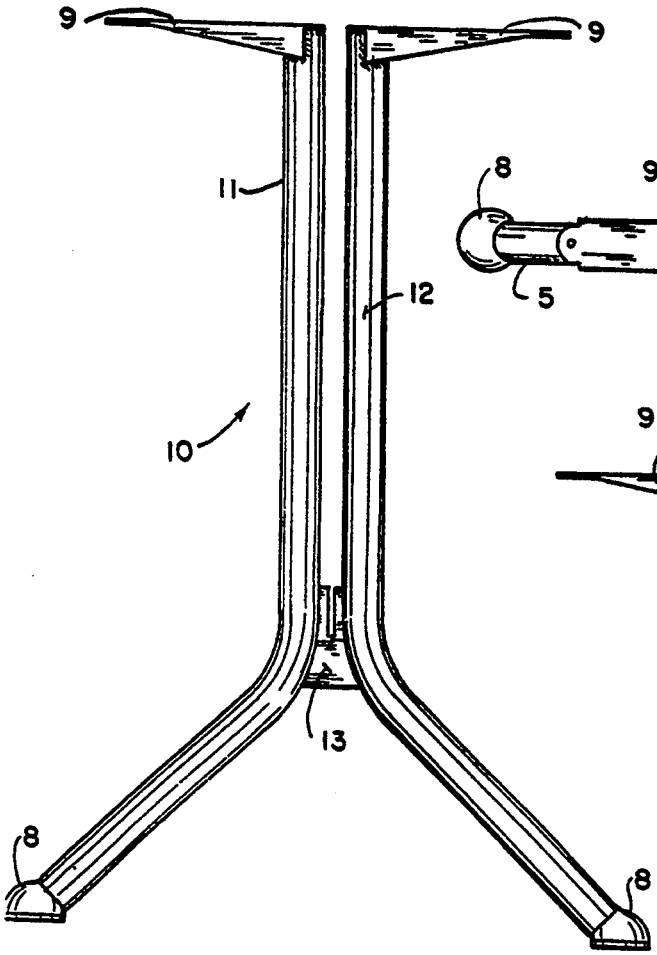
FIG. 7 is a front view of the other pair of legs forming one-half of the table pedestal, and which is designed to provide for its connector to intermate with the connector of the other pair of table legs as shown in FIG. 5.
Figure 5:
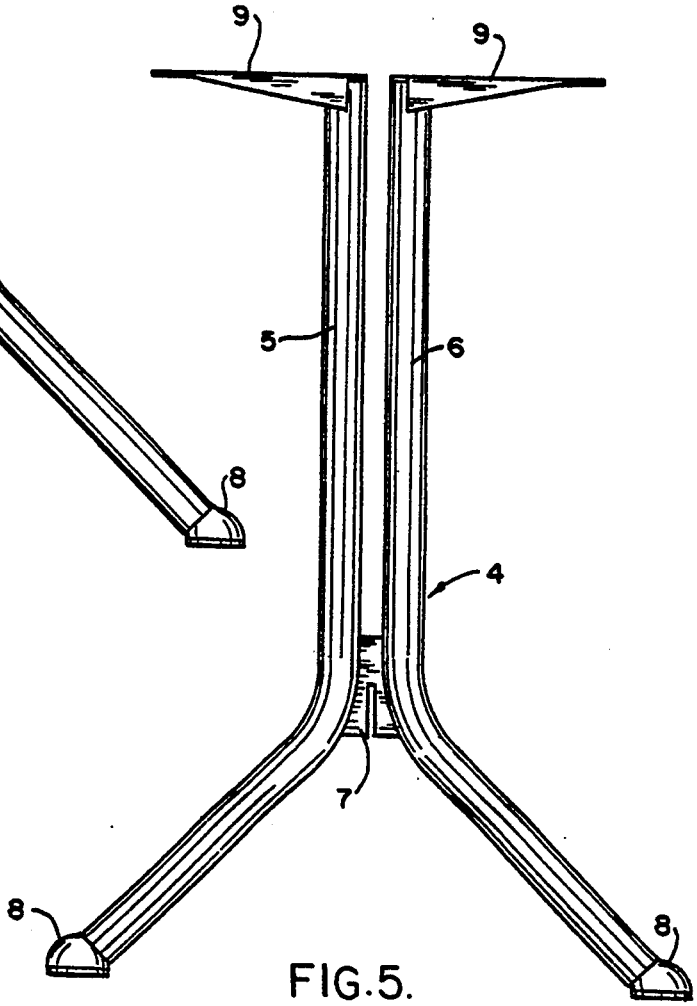
FIG. 5 is a front view thereof.
Figure 6:
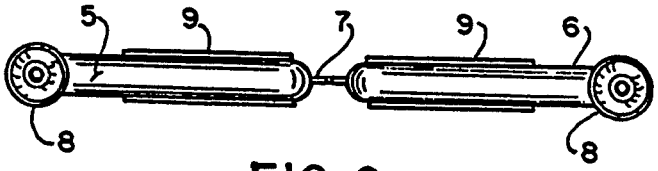
FIG. 6 is a bottom view thereof.

In referring to the drawings, and in particular FIG. 1, the intermating table legs of this invention, as at 1, are shown supporting a table top or surface, disclosed in phantom line at 2. Essentially, the pedestal 3 forming this table support is formed of four legs, with the pedestal being formed of two pairs of two legs each, fabricated in the arrangement as shown in FIGS. 5 and 7 of this disclosure. As can be seen in FIG. 5, the first pair of legs 4 are formed of two upright leg assemblies 5 and 6, as can be seen, and have intermediate thereof, and rigidly secured therewith, as by welding, or the like, a connector 7. The connector rigidly holds the two legs together, in their aligned and parallel position, as noted. At the bottom end of each leg is a foot 8, which is designed to buffer the resting of the table legs upon the floor, or other surface. At the upper end of each leg is a mounting plate 9, which are designed to accommodate threaded fasteners, or other securement, for affixing the intermating table legs to the underside of the table top, as at 2.

Figure 4:
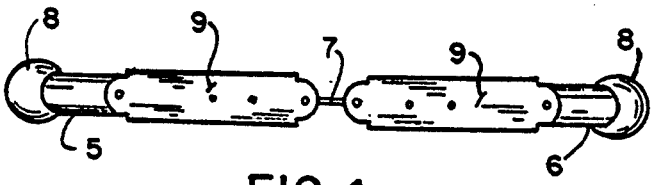
FIG. 4 is a top plan view of one of the pair of table legs before their assembly into the pedestal configuration.

The other and cooperating set of pair of table legs, as shown in FIG. 7, and as disclosed herein, include the pair of legs 10 that are once again formed of a pair of upright legs 11 and 12, and which have a connector 13 arranged intermediately thereof, and rigidly secured to the legs at the identified location, to fix this pair of table legs together. The bottom of each table leg includes an additional foot 8, with the upper end of each table leg having a mounting plate 9 secured thereto, as through welding, or other means of fastening. As can be seen in FIG. 4, each of the two legs forming a pair, regardless whether it be of the type as shown in FIG. 5, of FIG. 7, are generally of a flattened configuration, even after their various foot portions and mounting plates are secured therewith, so that the stacking of the table legs can be done, after their manufacture, and before the table is assembled into its operative condition, so that the entire table structure, when disassembled, can be shipped in a relatively flattened condition, as a result of the overall flatness of the variety of components that cooperate to form the table structure, including its leg segments.

Obviously, as can be further seen in FIGS. 5 and 7, the downward portions of each leg flare outwardly, as noted, in order to provide stable support for the table, when assembled, erected, and utilized.

Figure 8:
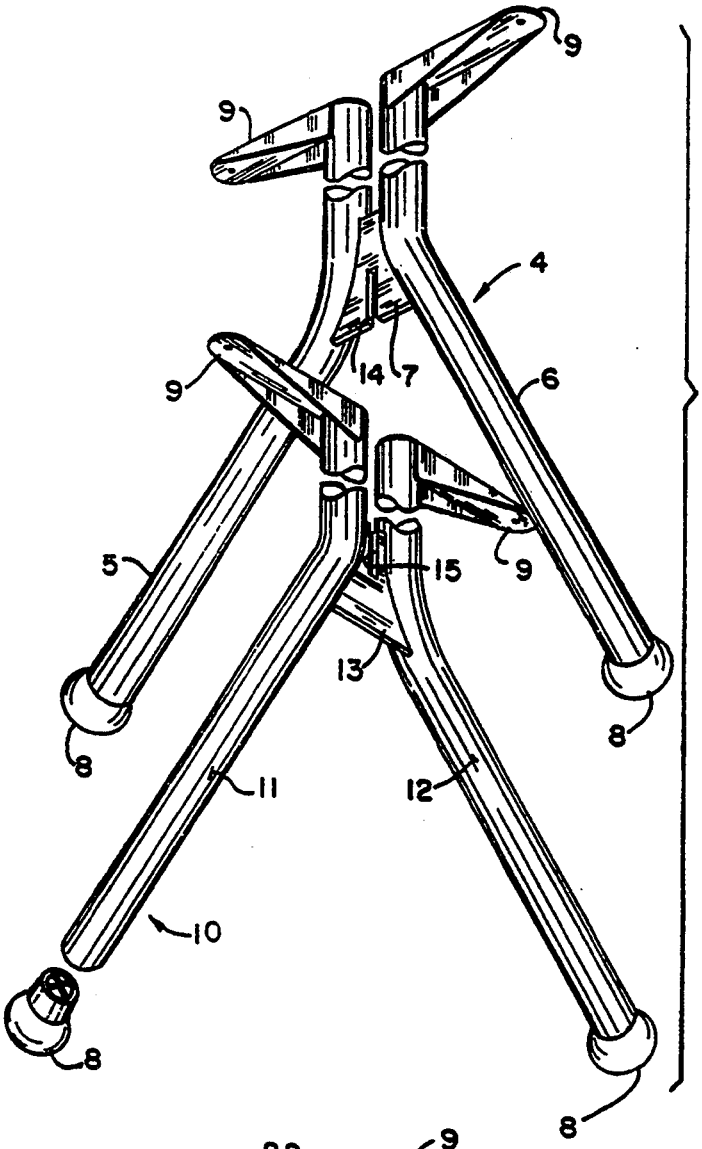
FIG. 8 discloses each pair of table legs, in this particular instance having their connectors disposed at an upward position, during their intermating and sliding engagement to form that perpendicularity necessary to structure the pedestal of this invention.
Figure 15:
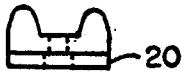
FIG. 15 shows a view of the foot with an insert to act as a buffer.
Figure 9A:
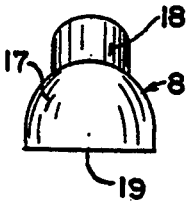
FIGS. 9A through 9D show various views, namely, front, side, top, and sectional views, for the type of foot that connects to the bottom of each table leg to provide a buffer when the table is rested upon the floor.
Figure 9B:
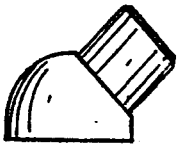
Figure 9C:
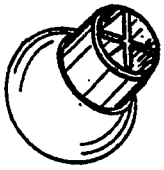
Figure 9D:
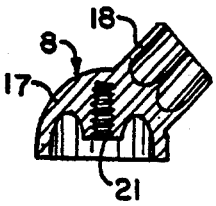

As can also be seen in FIG. 8, the various table leg assemblies 4 and 10 when installed into their operative condition provide for the intermating between the various connectors 7 and 13, and to achieve such, the connector 7 has a downwardly extending slot 14, which is designed to mate with the upwardly extending slot 15 of the connector 13. Thus, when these two connectors are interfitted together, the connectors snugly embrace each other, their slots fully insert together, in the manner as can be seen in FIG. 1, as noted at 16, to provide a very stable pedestal configuration for support of the table top, and for fully stabilizing the table, when assembled and erected for usage. Thus, a fully three dimensional table can be assembled in the manner as shown in FIG. 1, and utilized in that configuration. But, as can also be understood, when the table assemblies are packaged for warehousing, display, or shipment, after sale, the entire table can be packaged within a rather flattened container, since the leg assemblies 4 and 10, when unconnected, in the manner as shown in FIGS. 5 and 7, can be laid directly upon each other, and generally only possess any significant two dimensional length, since the depth of the unassembled item of furniture is only twice that of the width of the legs and mounting plates 9, since two pairs of leg assemblies are only required to provide the type of intermating table leg assembly 1, which when affixed together, in the manner as shown in FIG. 8, to provide a table pedestal as disclosed in FIG. 1, has significant perpendicularity, to provide full stability for the table top, when erected.

Each foot 8 for the assembled table is disclosed in FIG. 9. As shown, stem 18 extending upwardly, and designed for snug inserting within the lower end of each table leg, and be retained therein by means of a pressure fit, or the like. The bottom of each foot is flattened, as at 19, and is designed for having engaged therewith, a polymer, rubber, Teflon, or other form of impact resistant insert 20, that can be threadily engaged within the bottom of each foot 8, by insertion of a threaded screw or other fastener within the threaded slot 21. The purpose of this insert is to buffer the resting of the table upon the floor, and to reduce its marring or scratching as when the table is shifted, such as during usage.

Figure 10:
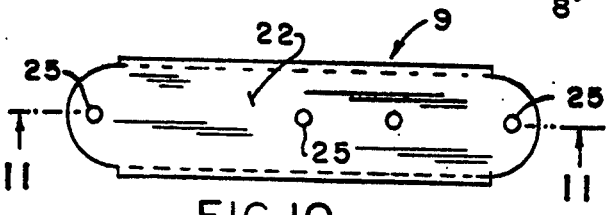
FIG. 10 is a top view of the mounting plate for each table leg as disclosed.
Figure 11:
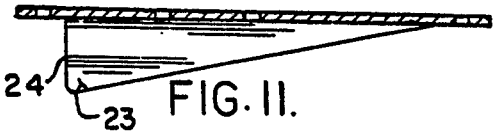
FIG. 11 is a sectional view of the mounting plate disclosed in FIG. 10, taken along the line 11—11 of FIG. 10.
Figure 12:
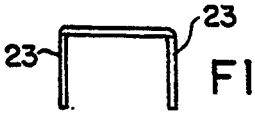
FIG. 12 is a left end view of the mounting plate disclosed in FIG. 10.

The mounting plates securing to the upper end of the various table legs are shown in FIGS. 10 through 12. As can be seen, each mounting plate includes an upper plate portion 22 which has downwardly bent flanges 23 secured therewith, either through an integral bending function, or by securement thereto as through welding, or the like. As can be seen, each flange 23 has a tappered configuration, in order to provide maximum strength at their thicker back ends, as at 24, where each mounting plate is welded or otherwise secured to the upper end of a table leg, such as the types as shown in FIGS. 5 and 7. A series of spaced apertures, as at 25, are provided through the plate portion 22, and can accommodate the insertion of the threaded screw thereto, to provide for the engagement of the table top to the upper end of the table leg assembly 1, as can be seen in FIG. 1.

Figure 13:
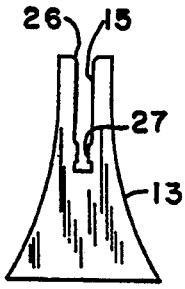
FIG. 13 is a side view of the connector provided between one pair of the table legs, such as those as shown in FIG. 7.
Figure 14:
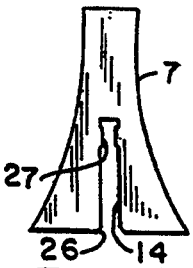
FIG. 14 is a side view of the connector interconnecting a pair of the table legs together, such as shown in FIG. 5.

The various connectors 13 and 7 are disclosed, respectively, in FIGS. 13 and 14. As can be seen, the particular slots 14 and 15 provided within each connector have detailed configuration, including beveled edges, as at 26 at their outer edges, in order to guide the two connectors together, during the interconnecting or intermating function, but at the inwardly end of each slot, there are reduced portions, as can be seen at 27, to assure a significantly tight mating of each connector, and their table leg assemblies 4 and 10, together, when they are arranged into perpendicularity, and slid together in the manner as shown in FIG. 8, to form the table pedestal of the type as disclosed in FIG. 1. Hence, the space of each reduced portion 27 is only fractionally greater than the thickness of the connector of the other pair of table legs when they are assembled together, in order to provide for that desired snugness in the assembly of the legs together, when the table is assembled into its usable condition.

Variations or modifications to the subject matter of this invention may occur to those skilled in the art upon reviewing the disclosure made herein. Such variations, if within the spirit of this invention, are intended to be encompassed within the scope of any claims to patent protection issuing upon this development. The description of the preferred embodiment as set forth herein is done so for illustrative purposes only.

Having thus described the invention, what is claimed and desired to be secured by Letters patent is:

1. A table, including a table surface, and having a pair of intermating table legs for forming a pedestal for said table, said legs comprising a pair of table legs, each table leg having a foot portion, and a mounting plate provided at the upper end of each table leg, said mounting plate extending substantially perpendicularly from said table leg, a connector means provided intermediate the pair of table legs, said connector means having means provided therein for securing with the connector of an additional pair of like table legs, said means for connecting the first of said table legs comprising a vertical slot formed within said connector means, and the additional pair of table legs having a connector means provided therebetween, and also incorporating a vertical slot therein, for intermating with the connector means of the first pair of table legs, so as to orient the two pair of table legs at a perpendicularity with respect to each other when the table is assembled, the first and additional pairs of table legs vertically sliding together with respect to each other for providing for interconnecting of their connector means together, to form the pedestal table legs for support of the table surface thereon, each vertical slot of a pair of legs having a reduced portion provided therein, so as to provide for snugness when the table legs are assembled together and to provide tightness in their interconnection when one pair of table legs are vertically slid into connection with the additional pair of table legs in forming said table pedestal, said mounting plate provided at the upper end of each table leg extending perpendicularly outwardly therefrom, each mounting plate having a flattened surface upwardly disposed, said flattened surface arranged for accommodating the support of the table surface thereon, for providing the fabricated table, each mounting plate having a tapering flange extending downwardly therefrom, providing structural support for the mounting plate in its securement of the table surface thereon.

2. The invention of claim 1, wherein said table leg connectors being disposed downwardly of the pairs of intermated table legs.

3. The invention of claim 1, wherein said connectors intermating the table legs together disposed upwardly of each pair of said table legs.

4. The invention of claim 1 wherein said foot portion for each table leg having an insert therein, said insert having a rounded portion, the bottom of said insert having a flattened configuration for resting upon the floor, and stem means integrally formed with the rounded portion of the foot to provide for its connection to the bottom of each table leg and for inserting within each table leg, said stem means for each insert being angularly arranged at an angle of less than 90° with the rounded portion for each insert.

5. The invention of claim 4 wherein each rounded portion of a foot having a cavity formed centrally therein, extending upwardly from its flattened bottom, and cushioning means disposed for mounting therein for buffering the support of the intermating table legs upon the floor.

6. The invention of claim 1 wherein each mounting plate along each side having a tapering flange extending downwardly therefrom, said mounting plate having a back end for attachment to the table leg, and having a front end extending radially away from said formed table leg, each tapering flange being thicker at the back ends of the mounting plate and tapering towards a thinner tapering flange at the front end of each mounting plate.

* * * * *